US012433399B2

(12) United States Patent
Nowak et al.

(10) Patent No.: US 12,433,399 B2
(45) Date of Patent: Oct. 7, 2025

(54) DESK WITH USER SELECTABLE ADJUSTMENTS FOR HOT DESKING

(71) Applicant: Google LLC, Mountain View, CA (US)

(72) Inventors: Marta Anna Nowak, Upper Arlington, OH (US); Michelle Kaufmann, Novato, CA (US); Christine Jean Wu, San Francisco, CA (US); Robert Hutton, IV, Providence, RI (US); Ayako Tanase, Cranston, RI (US); Joyce H. Lee, San Francisco, CA (US); Jennie Mari Bernstein, Berkeley, CA (US); David Radcliffe, Los Altos, CA (US)

(73) Assignee: GOOGLE LLC, Mountain View, CA (US)

( * ) Notice: Subject to any disclaimer, the term of this patent is extended or adjusted under 35 U.S.C. 154(b) by 147 days.

(21) Appl. No.: 17/983,555

(22) Filed: Nov. 9, 2022

(65) Prior Publication Data

US 2023/0140935 A1 May 11, 2023

Related U.S. Application Data

(60) Provisional application No. 63/277,402, filed on Nov. 9, 2021.

(51) Int. Cl.

| | |
|---|---|
| ***A47B 21/00*** | (2006.01) |
| ***A47B 21/02*** | (2006.01) |
| ***A47B 21/03*** | (2006.01) |

(52) U.S. Cl.

CPC ..... *A47B 21/0314* (2013.01); *A47B 21/02* (2013.01); *A47B 2021/0364* (2013.01);

(Continued)

(58) Field of Classification Search

CPC ..... A47B 21/0314; A47B 21/02; A47B 2021/0364; A47B 2021/066;

(Continued)

(56) References Cited

U.S. PATENT DOCUMENTS 2,901,307 A * 8/1959 Moore ..... A47F 3/142 312/140.3
2,944,861 A * 7/1960 Lessin ..... A47B 17/02 312/196

(Continued)

FOREIGN PATENT DOCUMENTS

CA 2788771 A1 * 4/2013 ..... G09F 13/18
CA 3018366 A1 * 3/2020 ..... A47B 21/02

(Continued)

OTHER PUBLICATIONS

English translation of DE202020103910 (Year: 2021).*

*Primary Examiner* — Janet M Wilkens
(74) *Attorney, Agent, or Firm* — DORITY & MANNING P.A.

(57) ABSTRACT

A desk includes a work surface, a casing, a carriage, a stand, and a plurality of actuators. The actuators are operable to selectively adjust a vertical position of the work surface, the stand between at least a stored position and a deployed position, and a lateral position of the carriage. The casing is mounted to the work surface and defines an interior volume sized for receipt of a display. The carriage is mounted to the stand and is configured for supporting the display. A controller is in operative communication with the actuators and is configured for receiving data corresponding to a desk configuration over a wireless network and activating one or more of the actuators to correspond to the desk configuration.

20 Claims, 7 Drawing Sheets

(52) U.S. Cl.
CPC ..... *A47B 2200/0071* (2013.01); *A47B 2200/0075* (2013.01)

(58) Field of Classification Search
CPC .... A47B 2200/0071; A47B 2200/0075; A47B 2200/0073; A47B 2200/12; A47B 2200/0062; A47B 9/20; A47B 21/04; A47B 17/02; A47B 2220/0097
USPC ..... 108/50.01, 50.02, 20, 147, 144.11, 60, 108/147.19, 96; 312/223.3, 196, 306, 312/312, 21, 298, 310; 248/188.2, 188.5
See application file for complete search history.

(56) References Cited

U.S. PATENT DOCUMENTS 3,083,417 A * 4/1963 Cook ..... A47B 41/00 312/196
7,207,278 B2 * 4/2007 Latino ..... A47B 21/0073 108/50.01
7,327,516 B2 * 2/2008 Wheeler ..... G03B 21/58 359/461
8,087,737 B2 * 1/2012 Shoenfeld ..... A47B 21/02 108/50.02
8,322,802 B2 * 12/2012 Boxenbaum ..... A47B 83/001 312/194
9,655,438 B1 * 5/2017 Shoenfeld ..... A47B 21/02
10,126,720 B2 * 11/2018 Liu ..... A47B 21/04
10,376,158 B2 * 8/2019 Desroches ..... A47B 9/00
10,827,829 B1 * 11/2020 Labrosse ..... G05B 15/02
11,266,232 B2 * 3/2022 Knapp ..... F16M 11/28
12,056,628 B2 * 8/2024 Wase ..... G06T 19/006
2007/0040482 A1 * 2/2007 Williams ..... A47B 29/00 312/21
2007/0041152 A1 * 2/2007 Rouleau ..... A47B 21/00 361/679.22
2007/0170826 A1 * 7/2007 Tsao ..... A47B 21/00 312/223.3
2009/0133609 A1 * 5/2009 Nethken ..... A47B 21/02 108/50.02
2013/0199420 A1 * 8/2013 Hjelm ..... A47B 21/00 108/50.11
2020/0054136 A1 * 2/2020 Deveze ..... H04W 4/80

FOREIGN PATENT DOCUMENTS

DE 202010002236 U1 * 7/2010 ..... A47B 17/02
DE 202020103910 U1 * 11/2021 ..... F21V 33/0056
KR 20100010524 U * 10/2010
WO WO-2008070184 A1 * 6/2008 ..... G06Q 30/02
WO WO-2009064246 A1 * 5/2009 ..... A47B 21/00

* cited by examiner

DESK WITH USER SELECTABLE ADJUSTMENTS FOR HOT DESKING

CROSS-REFERENCE TO RELATED APPLICATION

The present application is related and claims priority to U.S. Provisional Application No. 63/277,402 filed in the United States Patent and Trademark Office on Nov. 9, 2021, which is incorporated by reference in its entirety for all purposes.

FIELD

The present disclosure relates generally to desks for collaborative work environments, such as hot desking.

BACKGROUND

Modern workspaces frequently include shared desks. In such workspaces, various users may use a single desk throughout a workday. For instance, a first user may use a desk in the morning, and a second user may use the same desk in the afternoon. By sharing desks, such workspaces can encourage efficient usage of valuable resources.

Current desks in shared workspaces have drawbacks. Some users find that shared desks limit connecting with colleagues and the adjacent workspace. In addition, each user of a shared desk may have a different arrangement to meet the user's ergonomic requirements, and current desks have limited adjustability. Each user may also have different technology requirements, and current desks have limited compatibility.

A desk with features for improving user satisfaction in shared workspaces would be useful.

SUMMARY

Aspects and advantages of embodiments of the present disclosure will be set forth in part in the following description, or may be learned from the description, or may be learned through practice of the embodiments.

Aspects of the present disclosure are directed to a desk that includes a work surface. A first actuator is coupled to the work surface. The first actuator is operable to selectively adjust a vertical position of the work surface. A casing is mounted to the work surface. The casing defines an interior volume sized for receipt of a display. The desk also includes a stand. A second actuator is coupled to the stand. The second actuator is operable to selectively adjust the stand between at least a stored position and a deployed position. The stand is positioned within the interior volume of the casing in the stored position of the stand, and the stand is at least partially positioned outside of the interior volume of the casing in the deployed position of the stand. A carriage is mounted to the stand. The carriage is configured for supporting the display. A third actuator is coupled to the carriage. The third actuator is operable to selectively adjust a lateral position of the carriage. A controller is in operative communication with the first, second, and third actuators. The controller is configured for receiving data corresponding to a desk configuration over a wireless network. The desk configuration includes a predetermined vertical position for the work surface, a predetermined position for the stand, and a predetermined lateral position for the carriage.

The controller is also configured for activating one or more of the first, second, and third actuators to correspond to the desk configuration.

Aspects of the present disclosure are also directed to a method for adjusting a desk that includes a plurality of actuators. The actuators are operable to selectively adjust a vertical position of a work surface, to selectively adjust a stand between at least a stored position within a casing and a deployed position at least partially outside of the casing, and to selectively adjust a lateral position of a carriage on the stand. The method includes receiving, at a controller of the desk, data corresponding to a desk configuration over a wireless network. The desk configuration includes a predetermined vertical position for the work surface, a predetermined position for the stand, and a predetermined lateral position for the carriage. The method also includes activating, by the controller, one or more of the first, second, and third actuators to correspond to the desk configuration.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures.

DETAILED DESCRIPTION

Figure 1:
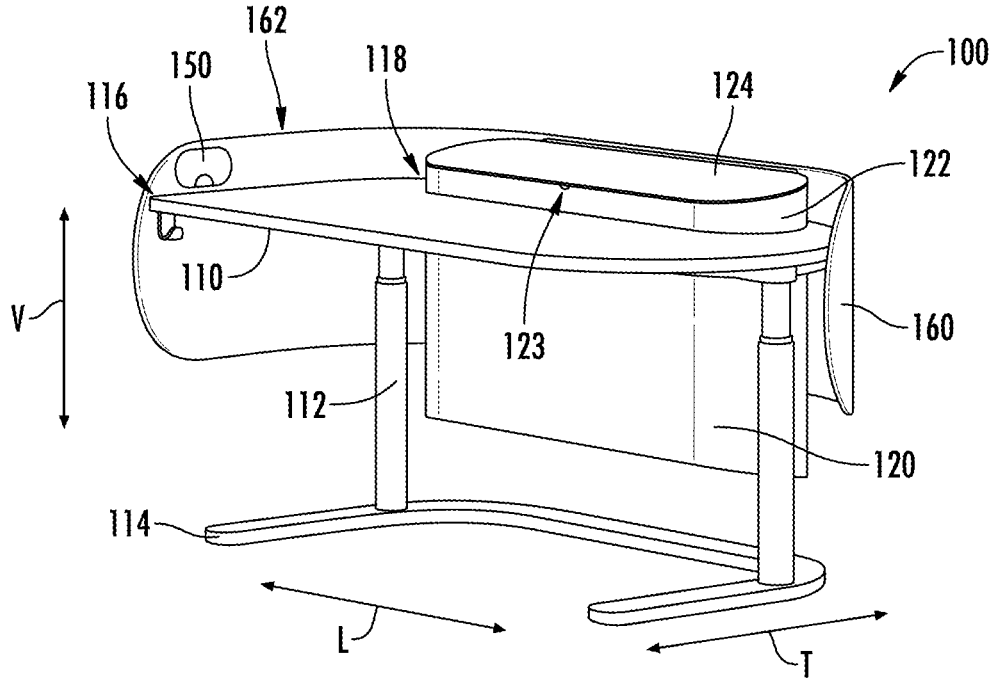
FIG. 1 is a front, perspective view of a desk according to an example embodiment of the present subject matter.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment.

Thus, it is intended that aspects of the present disclosure cover such modifications and variations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Generally, the present disclosure is directed to an agile desk with features for automatically loading ergonomic preferences of a user upon activation of the desk. For instance, the desk can automatically adjust one or more of a work surface height, a display height, a display tilt, etc. to predetermined user settings in response to the user reserving the desk, the user arriving at the desk, the user checking in at the desk, etc. By automatically adjusting the desk to the preferred ergonomic settings of the user, the user may advantageously avoid wasteful setup time required to adjust the desk. When not in use, the desk may adjust to a default configuration, e.g., in which the display is stowed within the desk. Thus, the desk may advantageously have a reduced visual impact, improve light transmission when not in use, and encourage face-to-face collaboration between users at nearby desks.

The desk may include multiple actuators, including an actuator for vertical desk adjustment, an actuator for selectively deploying a display, an actuator for lateral display adjustment, and/or an actuator for display joint adjustment. Each of the actuators may be operated by a controller of the desk. A laptop computer of the user may be connected to the display by a single cable, e.g., that also charges the laptop computer. The desk may also have one or more chargers, such as Universal Serial Bus (USB) ports, for charging personal devices of the user. As a particular example, the desk may include an induction charger, e.g., integrated into a work surface of the desk for wirelessly charging devices on the desk.

The desk may also include a screen or surround that extends upwardly from the work surface of the desk. A height of the screen may be adjusted by the user. The screen may assist with providing a sense of agency over the work experience at the desk, e.g., by raising the screen to provide visual privacy and reduced visual distraction or lowering the screen to encourage conversations and openness.

The desk according to example aspects of the present disclosure may adventurously provide a seamless end-to-end agile seating experience to give users flexibility in shared workspaces. By integrating technology, physical adjustability, personalization, and wayfinding, the desk may provide a flexible and collaborative workplace for multiple different users of the desk.

Referring now to the figures, a desk 100 will be described in accordance with example aspects of the present subject matter. As discussed in greater detail below, desk 100 may include features for adjusting to ergonomic requirements of a user. Desk 100 may define a vertical direction V, a lateral direction L, and a transverse direction T. The vertical direction V, lateral direction L, and transverse direction T may be mutually perpendicular and form an orthogonal direction system.

With reference to FIGS. 1 through 9, desk 100 includes a work surface 110. A user of desk 100 may utilize work surface 110 for writing, typing, etc. Thus, e.g., the user of desk 100 may position a laptop or tablet computer on work surface 110. A shape of work surface 110 may be rectangular, oval, etc. Work surface 110 may be sized to facilitate work thereon. For instance, work surface 110 may have a surface area (e.g., in a plane that is perpendicular to the vertical direction V) no less than a half of a square meter (0.5 $m^2$) and no greater than two square meters (2 $m^2$). As another example, work surface 110 may have a surface area no less than eight-tenths of a square meter (0.8 $m^2$) and no greater than one and a half square meters (1.5 $m^2$). Such sizing of work surface 110 may advantageously allow space for work items of a user, such as a computer, keyboard, mouse, bag, notebook, folders, etc. It will be understood that the sizing of work surface 110 recited above is provided by way of example only, and the surface area of work surface 110 may be sized differently in alternative embodiments. Work surface 110 may be constructed of or with a suitable sheet material, such as plywood, press-board, OSB, etc.

Desk 100 may include one or more legs 112 for supporting work surface 110. Legs 112 extend downwardly along the vertical direction V from work surface 110, e.g., to a base or foot 114. Work surface 110 may be moveable vertically on legs 112. For instance, desk 100 may include a first actuator 210 (FIG. 10) coupled to work surface 110. First actuator 210 may be operable to selectively adjust a vertical position of work surface 110. Thus, e.g., first actuator 210 may selectively adjust a height of work surface 110 along the vertical direction V relative to the ground below desk 100. First actuator 210 may be disposed within leg 112. Thus, first actuator 210 may be referred to as a leg actuator herein. First actuator 210 may include an electric motor, e.g., coupled to a threaded shaft, and a brake, as will be understood by those skilled in the art.

Figure 4:
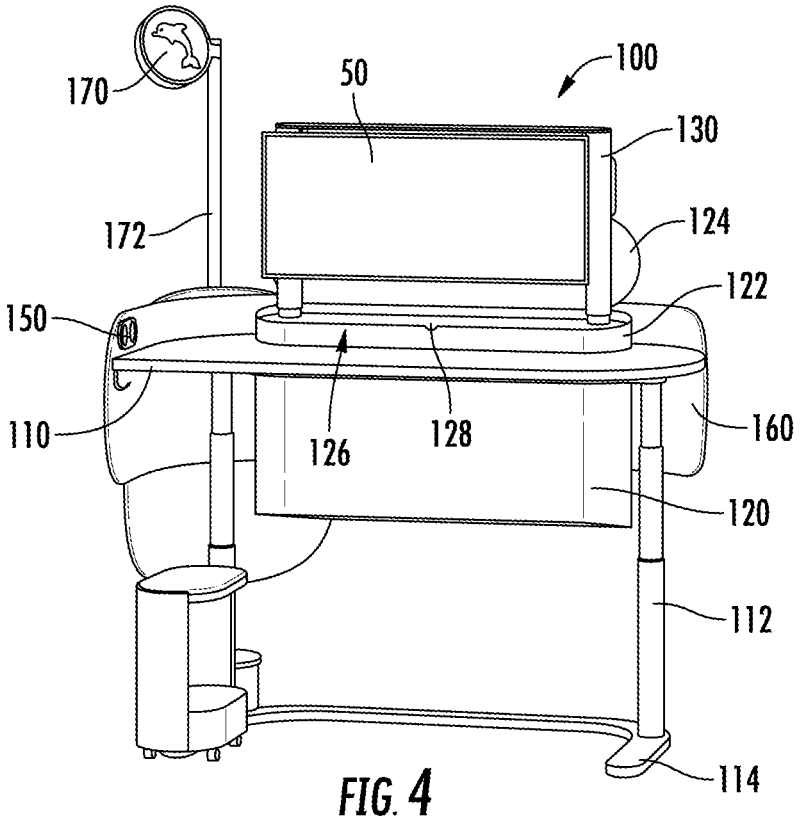
FIG. 4 is a front, perspective view of the example desk of FIG. 3 with the wayfinder shown illuminated.
Figure 5:
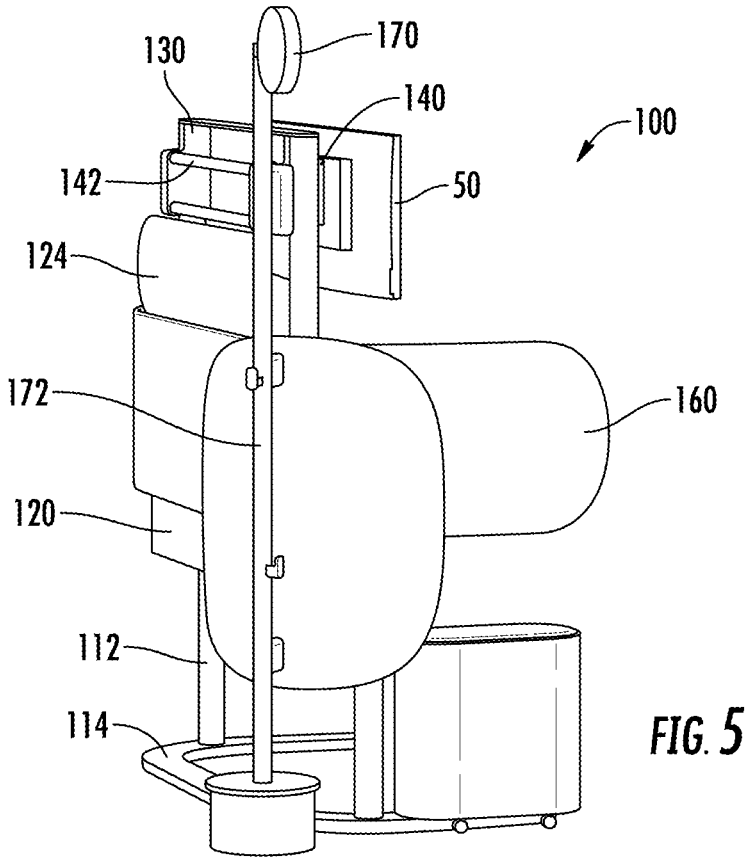
FIG. 5 is a rear, perspective view of the example desk of FIG. 3.

Utilizing first actuator 210, a user of desk 100 may adjust work surface between a sitting configuration (FIG. 1) and a standing configuration (FIG. 4). Thus, e.g., first actuator 210 may be configured for adjusting the height of work surface 110 along the vertical direction V by no less than three-tenths of a meter (0.3 m) and no greater than one meter (1 m) in certain example embodiments. In certain example embodiments, first actuator 210 may be configured for adjusting the height of work surface 110 along the vertical direction V within a range of no less than about a half meter (0.5 m) and no greater than about one and two-tenths meters (1.2 m) above the ground below desk 100.

A casing 120 may be mounted to work surface 110. Casing 120 may define an interior volume 121 (FIG. 7) sized for receipt of a display 50. Thus, as discussed in greater detail below, display 50 may be selectively disposed within interior volume 121 of casing 120. Casing 120 may be configured as a housing for display 50 when a user of desk 100 is not using display 50. For instance, certain users of desk 100 may prefer to work without a computer or from only a display integrated within a laptop or tablet of the user. By selectively housing display 50, casing 120 may advantageously allow display 50 to be stored in a cosmetically pleasing manner when not in use. Moreover, when display 50 is disposed within interior volume 121 of casing 120, the user of desk 100 may feel an increased connection with adjacent colleagues and/or more light may reach desk 100 as compared to when display 50 is deployed outside of interior volume 121 of casing 120.

Casing 120 may be sized to house display 50 within interior volume 121 of casing 120. A width of casing 120, e.g., along the lateral direction L, may be selected to assist with housing display 50 within casing 120. For instance, the width of casing 120 may be no greater than one and a half meters (1.5 m) in certain example embodiments. A height of casing 120, e.g., along the lateral direction V, may also be selected to assist with housing display 50 within casing 120. For instance, the height of casing 120 may be no greater than three-quarters of a meter (0.75 m) in certain example embodiments. Thus, large, e.g., curved, displays may be advantageously housed within interior volume 121 of casing 120.

Desk 100 may also include a stand 130. Stand 130 may be configured for supporting display 50 thereon, as discussed in greater detail below. Stand 130 may be mounted to casing 120, and stand 130 may be moveable vertically relative to work surface 110. For instance, desk 100 may include a second actuator 220 (FIG. 10) coupled to stand 130. Second actuator 220 may be operable to selectively adjust a vertical position of stand 130. Thus, e.g., second actuator 220 may selectively adjust a height of stand 130 along the vertical direction V relative to work surface 110. Second actuator 220 may be disposed within a leg of stand 130. Second actuator 220 may be referred to as a display actuator herein. Like first actuator 210, second actuator 220 may include an electric motor, e.g., coupled to a threaded shaft, and a brake.

Figure 2:
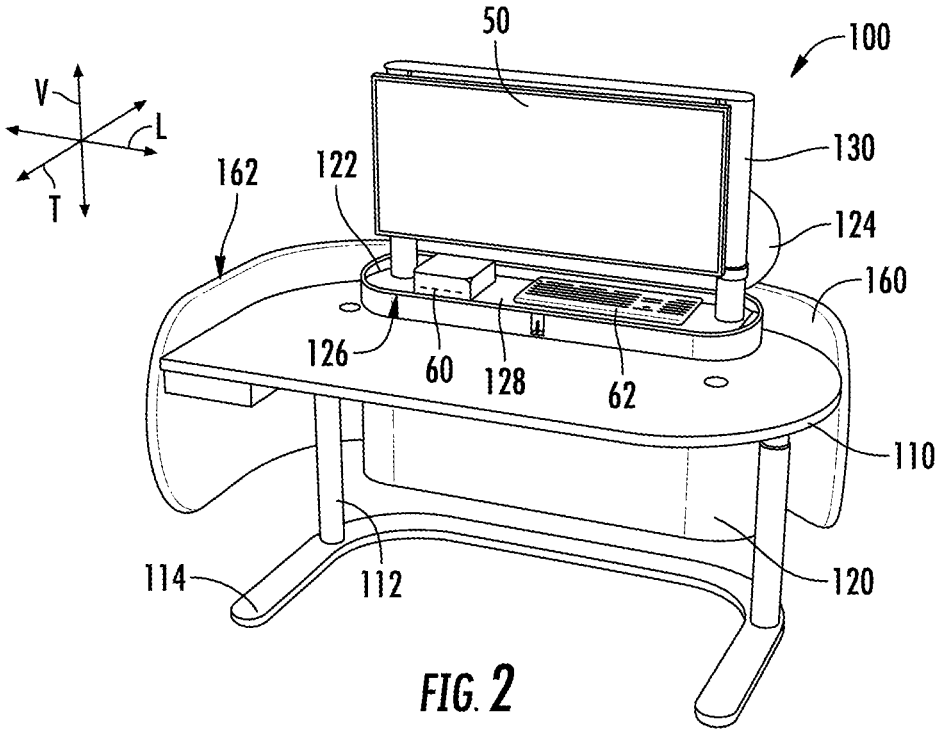
FIG. 2 is a front, perspective view of the example desk of FIG. 1 with a stand shown in a deployed position.

Second actuator 220 may be configured for selectively adjusting stand 130 between at least a stored position (FIG. 1) and a deployed position (FIG. 2). Stand 130 may be positioned within interior volume 121 of casing 120 in the stored position of stand 130. Conversely, stand 130 may be at least partially positioned outside of interior volume 121 of casing 120 in the deployed position of stand 130. As shown in FIGS. 1 and 2, display 50 on stand 130 may be selectively moved into and out of interior volume 121 of casing 120 by adjusting stand 130 between the stored position and the deployed position. Thus, second actuator 220 may selectively move display 50 into and out of interior volume 121 of casing 120. In certain example embodiments, second actuator 220 may be selectively move stand 130 along a vertical range of travel that is no less than half of a meter (0.5 m) and no greater than nine-tenths of a meter (0.9 m).

Casing 120 may include a barrel 122 and a lid 124. Barrel 122 may be mounted to work surface 110, e.g., at a rear portion 116 of work surface 110. Thus, barrel 122 may be positioned opposite a front portion 118 of work surface 110, e.g., along the transverse direction T. The user may sit or stand adjacent the front portion 118 of work surface 110. Display 50 may be receivable within barrel 122.

Lid 124 may be pivotally coupled to barrel 122, e.g., with a hinge, at an opening 126 of barrel 122. Lid 124 may selectively cover interior volume 121 of casing 120. For example, lid 124 may be selectively movable between a closed position (FIG. 1) and an open position (FIG. 2). In the closed position, lid 124 may be positioned over and limit access to interior volume 121 of casing 120. Display 50 may be positioned within interior volume 121 of casing 120 when lid 124 is in the closed position. Conversely, lid 124 may be rotated away from the closed position into the open position in order to allow access to interior volume 121. As an example, display 50 may be positioned outside of interior volume 121 of casing 120 when lid 124 is in the open position. Lid 124 may be biased, e.g., with a spring, towards the closed position. Thus, lid 124 may be normally closed.

Opening 126 of barrel 122 may be positioned above work surface 110, e.g., along the vertical direction V. Thus, lid 124 may also be positioned above work surface 110, e.g., along the vertical direction V. A distance between opening 126 of barrel 122 and work surface 110, e.g., along the vertical direction V, may be no greater than a tenth of a meter (0.1 m) in certain example embodiments. Thus, lid 124 may form a pedestal of the user of desk 100 when display 50 is positioned within interior volume 121 of casing 120 and lid 124 is in the closed position. The user of desk 100 may place various items on the pedestal. As an example, the user of desk 100 may position a laptop or tablet computer on top of lid 124 when lid 124 is in the closed position.

Barrel 122 may define a handle slot 123 for lid 124 at opening 126. A user of desk 100 may manually lift lid 124 from the closed position to the open position by inserting a finger into handle slot 123 and lifting upwardly on lid 124, e.g., along the vertical direction V. As another example, the user may lift upwardly on the edge of lid 124 facing front portion 118 of work surface 110 to manually lift lid 124 from the closed position to the open position.

Figure 8:
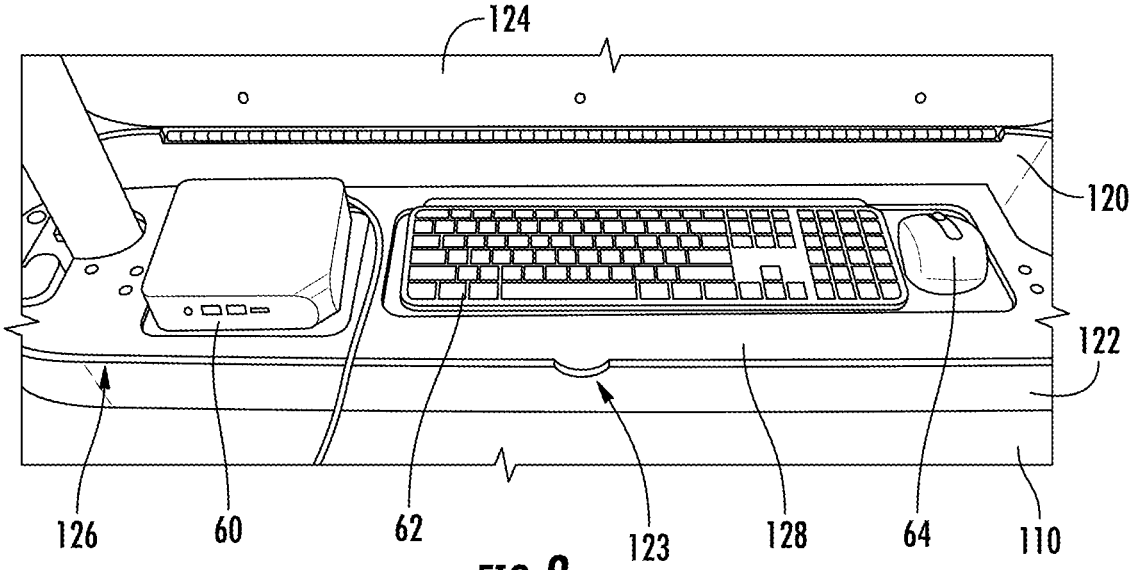
FIG. 8 is a perspective view of a tray of the example desk of FIG. 1.

Casing 120 may also include a tray 128. Tray 128 may be mounted within interior volume 121 of casing 120. As shown in FIG. 8, tray 128 may be configured for supporting one or more of a mouse 64, a keyboard 62, and a desktop computer 60. Tray 128 may thus support various accessories for a user of desk 100. Such accessories may, e.g., operate in combination with display 50 to facilitate work of the user at desk 100. Tray 128 may be positioned at a bottom portion of casing 120 when stand 130 is in the stored position. Conversely, tray 128 may be positioned at a top portion of casing 120 (e.g., at opening 126 of barrel 122) when stand 130 is in the deployed position. Thus, second actuator 220 may also move tray 128, e.g., along the vertical direction V, within casing 120 when second actuator 220 moves display 50 into and out of interior volume 121 of casing 120. Lid 124 may cover tray 128 when lid 124 is in the closed position.

Desk 100 may also include a carriage 140 (FIG. 5) mounted to stand 130. In particular, carriage 140 may be mounted to stand 130 such that carriage 140 is movable, e.g., along the lateral direction L. For example, carriage 140 may be movable on one or more rails 142 relative to stand 130. For instance, desk 100 may include a third actuator 230 (FIG. 10) coupled to carriage 140. Third actuator 230 may be operable to selectively adjust the lateral position of carriage 140. Thus, e.g., third actuator 230 may selectively adjust a position of carriage 140 along the lateral direction L relative to work surface 110. Third actuator 230 may be disposed within carriage 140. Third actuator 230 may be referred to as a lateral actuator herein. Third actuator 230 may include an electric motor, e.g., coupled to a threaded shaft, and a brake.

Carriage 140 may be configured for supporting display 50. For example, display 50 may be mounted on carriage 140. Thus, display 50 may move, e.g., along the lateral direction L, with carriage 140 when display 50 is mounted carriage 140. Moreover, third actuator 230 may be configured for selectively moving carriage 140 and display 50, e.g., along the lateral direction L. In such a manner, a user positioned at front portion 118 of work surface 110 may adjust the viewing angle of display 50 by moving carriage 140 and display 50, e.g., along the lateral direction L, with third actuator 230. Third actuator 230 may be configured for adjusting the position of carriage 140 along the lateral direction L by no less than two-tenths of a meter (0.2 m) and no greater than eight-tenths of a meter (0.8 m) in certain example embodiments.

Figure 9:
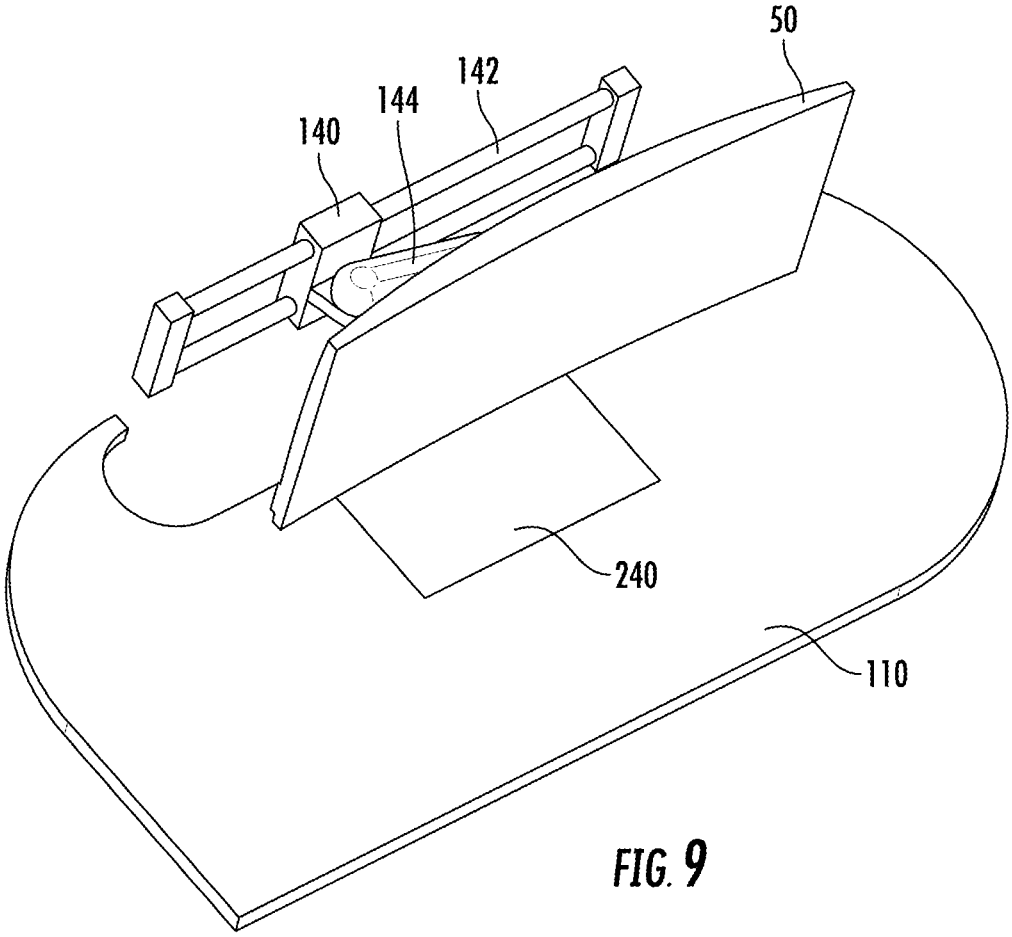
FIG. 9 is a perspective view of certain components of the example desk of FIG. 1, including a swing arm.

Desk 100 may also include a swing arm 144 (FIG. 9). Swing arm 144 may be mounted to carriage 140. Thus, e.g., swing arm 144 may move, e.g., along the lateral direction L, with carriage 140. Swing arm 144 may be configured for supporting display 50. For instance, display 50 may be mounted at a distal end of swing arm 144. Swing arm 144 may pivot (e.g., about a vertical axis) relative to carriage 140. Thus, e.g., an angle of display 50 may be adjusted by a user of desk 100 by pivoting swing arm 144. Moreover, a fourth actuator 240 may be coupled to swing arm 144. Fourth actuator 240 may be operable to selectively adjust a tilt of display 50 on swing arm 144. Fourth actuator 240 may be referred to as an arm actuator herein. Swing arm 144 may include at least two joints in certain example embodiments, with rotational axes at each joint. Fourth actuator(s) 240 may be operable to adjust the angle of display 50 by rotating swing arm 144 at each joint.

Figure 10:
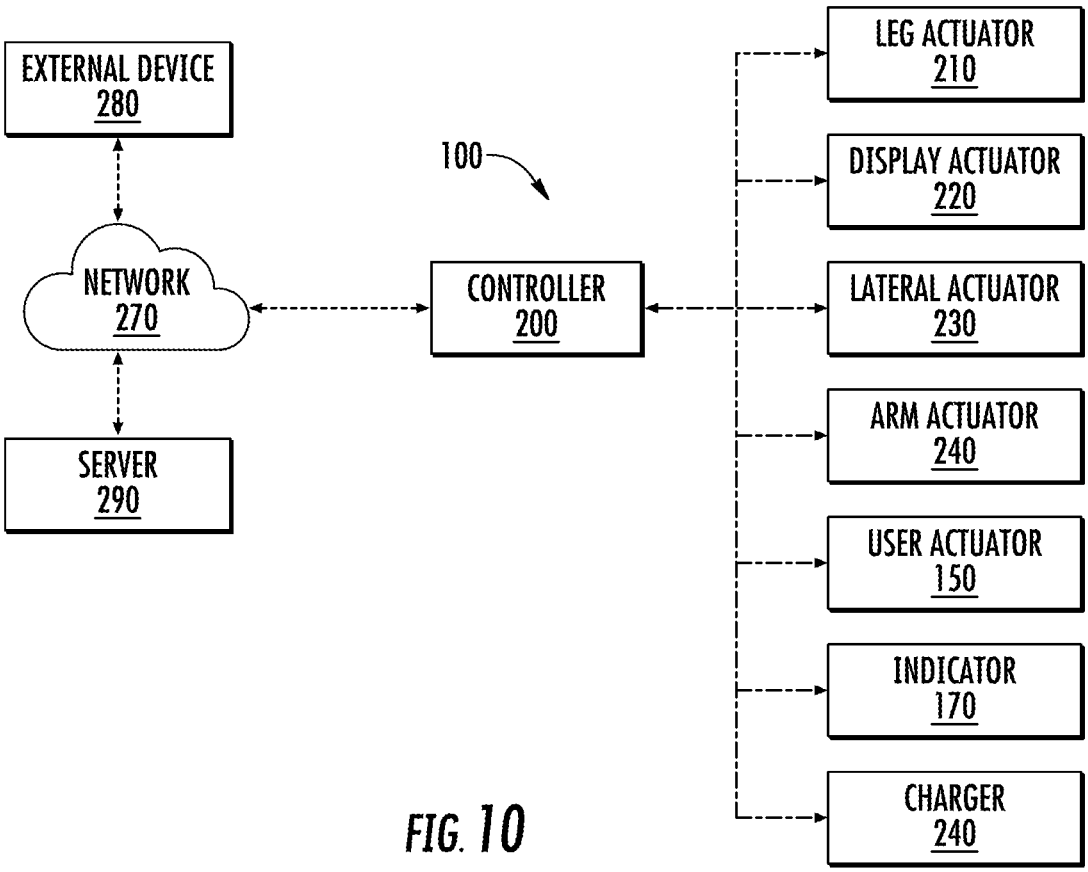
FIG. 10 is a schematic view of certain components of the example desk of FIG. 1.

With reference to FIG. 10, operation of desk 100 may be regulated by a controller 200 that is operatively coupled to various other components, as will be described below. Generally, in response to user manipulation of a control panel 150 on controller 200 or one or more command signals, controller 200 may operate various components of desk 100. Controller 200 may include a memory and one or more microprocessors, CPUs or the like, such as general or special purpose microprocessors operable to execute programming instructions or micro-control code associated with operation of desk 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 200 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 200 may be positioned in a variety of locations throughout desk 100. In the illustrated embodiments, controller 200 is located within behind control panel 150 proximate front portion 118 of work surface 110. Input/output ("I/O") signals may be routed between controller 200 and various operational components of desk 100. For example, control panel 150 and actuators 210, 220, 230 may be in communication with controller 200 via one or more signal lines or shared communication busses. Additionally or alternatively, controller 200 may be in communication with various other components of desk 100. As discussed, control panel 150 may additionally be in communication with the controller 200. Thus, various operations may occur based on user input or automatically through controller 200 instruction.

Controller 200 may also be configured for communicating with one or more external devices 280 and/or servers 290 via a network 270. In general, controller 200 is configured for permitting interaction, data transfer, and other communications between desk 100 and one or more external devices 280 and/or servers 290. For example, this communication may be used to provide and receive operating parameters, user instructions or notifications, performance characteristics, user preferences, or any other suitable information for improved performance of desk 100. In addition, it should be appreciated that controller 200 may transfer data or other information to improve performance of one or more external devices and/or improve user interaction with such devices.

As a particular example, controller 200 of desk 100 may communicate with a separate device external to desk 100, referred to generally herein as an external device 280. These communications may be facilitated using a wired or wireless connection, such as via a network 270. In general, external device 280 may be any suitable device separate from desk 100 that is configured to provide and/or receive communications, information, data, or commands from a user. In this regard, external device 280 may be, for example, a personal phone, a smartphone, a tablet, a laptop or personal computer, a wearable device, or another mobile or remote device.

In addition, a remote server 290 may be in communication with desk 100 and/or external device 280 through network 270. In this regard, for example, remote server 290 may be a cloud-based server, and is thus located at a distant location, such as in a separate city, state, country, etc. According to an exemplary embodiment, external device 280 may communicate with a remote server 290 over network 270, such as the Internet, to transmit/receive data or information, provide user inputs, receive user notifications or instructions, interact with or control desk 100, etc. In addition, external device 280 and remote server 290 may communicate with desk 100 to communicate similar information.

In general, communication between desk 100, external device 280, remote server 290, and/or other user devices or appliances may be carried using any type of wired or wireless connection and using any suitable type of communication network, non-limiting examples of which are provided below. For example, external device 280 may be in direct or indirect communication with desk 100 through any suitable wired or wireless communication connections or interfaces, such as network 270. For example, network 270 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

The external communication system of desk 100 is described herein according to an exemplary embodiment of the present subject matter. However, it should be appreciated that the exemplary functions and configurations of the external communication system provided herein are used only as examples to facilitate description of aspects of the present subject matter. System configurations may vary, other communication devices may be used to communicate directly or indirectly with one or more associated desk, other communication protocols and steps may be implemented, etc. These variations and modifications are contemplated as within the scope of the present subject matter.

As noted above, controller 200 may be in operative communication with first, second, third, and fourth actuators 210, 220, 230, 240. Thus, controller 200 may selectively adjust one or more of: (1) a vertical position of work surface 110 with first actuator 210; (2) a vertical position of stand 130 with second actuator 220; (3) a lateral position of carriage 140 with third actuator 230; and a tilt of display 50 on swing arm 144 with fourth actuator 240. As discussed in greater detail below, the present subject matter may assist with adjusting such ergonomic settings of desk 100, e.g., automatically, to match preferences of a user of desk 100.

In certain example embodiments, controller 200 may be configured for receiving data corresponding to a desk configuration over network 270. The desk configuration may include one or more of: (1) a predetermined vertical position of work surface 110; (2) a predetermined vertical position of stand 130; (3) a predetermined lateral position of carriage 140; and a predetermined tilt of display 50 on swing arm 144. Such settings may be previously selected by the user of desk 100. For instance, the desk configuration may correspond to the last settings input by the user into control panel 150. Thus, the desk configuration may correspond to the previously selected by the user on desk 100 (or another desk) at control panel 150. The desk configuration may be saved on controller 200, external device 280, and/or server 290 in such example embodiments. As another example, the user may input and save the desk configuration on external device 280. Thus, e.g., the user may utilize an app on external device 280 to input and save the desk configuration locally on external device 280, and external device 280 may transmit the desk configuration to controller 200 each time that the user utilizes at desk 100. As yet another example, the user may utilize an app on external device 280 to input and save the desk configuration remotely on server 290, and server 290 may transmit the desk configuration to controller 200 each time that the user utilizes at desk 100. Controller 200 may transmit a request for the desk configuration to server 290, e.g., in response to a user input at control panel 150, such as a keypad input, a badge scan, etc. As another example, controller 200 may transmit a request for the desk configuration to external device 280 or server 290, e.g., in response to a user input detected by external device 280, such as a gesture or motion detected by a Soli chip on external device 280.

Controller 200 may also be configured for activating one or more of first, second, third, and fourth actuators 210, 220, 230, 240 to correspond to the desk configuration. For instance, if the user prefers to stand at desk 100, controller 200 may operate first actuator 210 to adjust vertical position of work surface 110 such that the user can stand at work surface 110. Conversely, if the user prefers to sit at desk 100, controller 200 may operate first actuator 210 to adjust vertical position of work surface 110 such that the user can sit at work surface 110. As another example, if the user prefers to not use display 50, controller 200 may operate second actuator 220 to adjust stand 130 to the stored position such that display 50 is disposed within casing 120. Conversely, if the user prefers to utilize display 50 with desk 100, controller 200 may operate second actuator 220 to adjust stand 130 to the deployed position such that display 50 is usable by the user at desk 100. As yet another example, the user may prefer than display 50 be positioned at a center of work surface 110, and controller 200 may operate third actuator 230 to adjust carriage 140 such that display 50 is positioned at the center of work surface 110. Conversely, the user may prefer than display 50 be positioned at a side of work surface 110, and controller 200 may operate third actuator 230 to adjust carriage 140 such that display 50 is positioned at the side of work surface 110. As may be seen from the above, controller 200 may adjust the ergonomic settings of desk 100 to match predetermined setting of a user.

Figure 6:
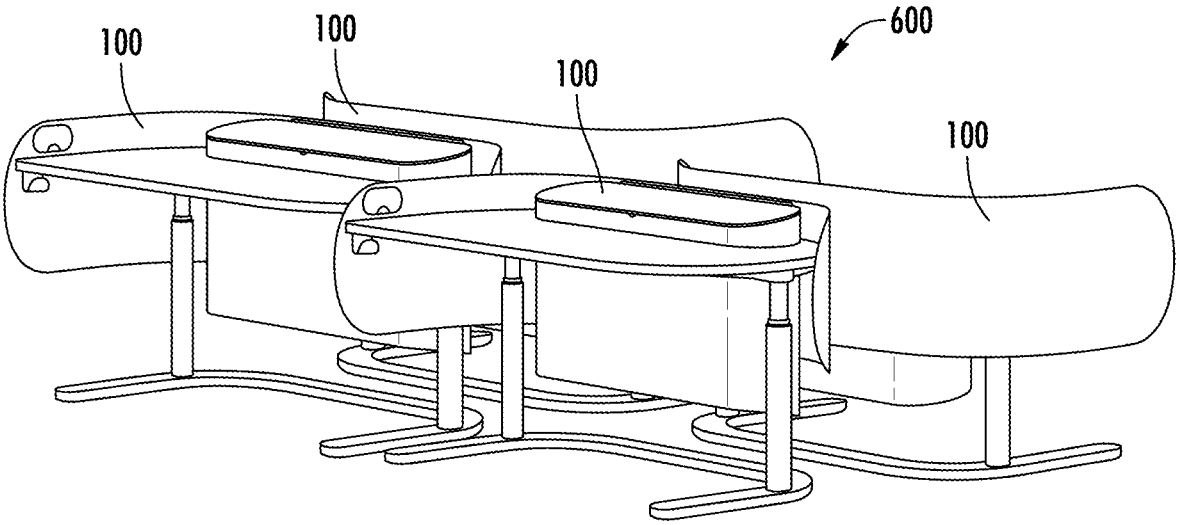
FIG. 6 is a perspective view of a plurality of the example desks of FIG. 1.
Figure 7:
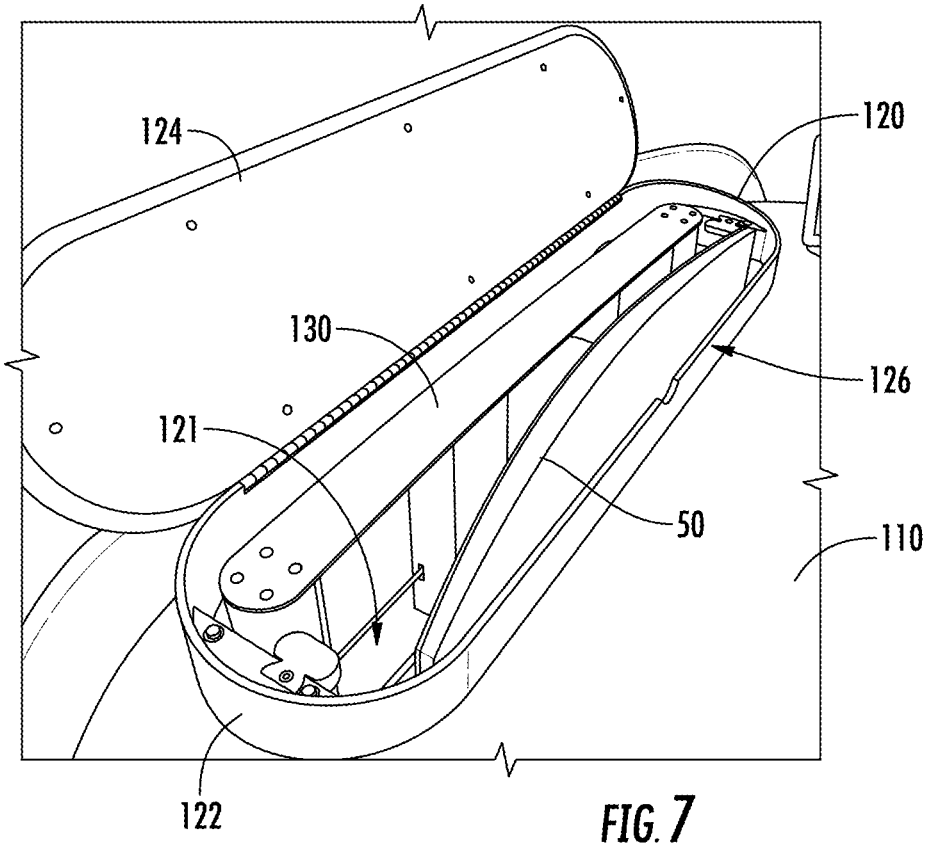
FIG. 7 is a perspective view of a casing of the example desk of FIG. 1 with a lid shown in an open position.

Desk 100 may be utilized in a hot desking environment. For instance, as shown in FIG. 6, a plurality of desks 100 may be positioned adjacent one another, and users may reserve one of desks 100 for a period of time. By automatically loading the desk configuration for a user (e.g., when the reservation period of the user begins, when the user checks into the desk, when the user arrives at the desk, etc.) desk 100 may be assist with reducing setup time for the user and/or deliver a consistent agile desk experience.

Figure 3:
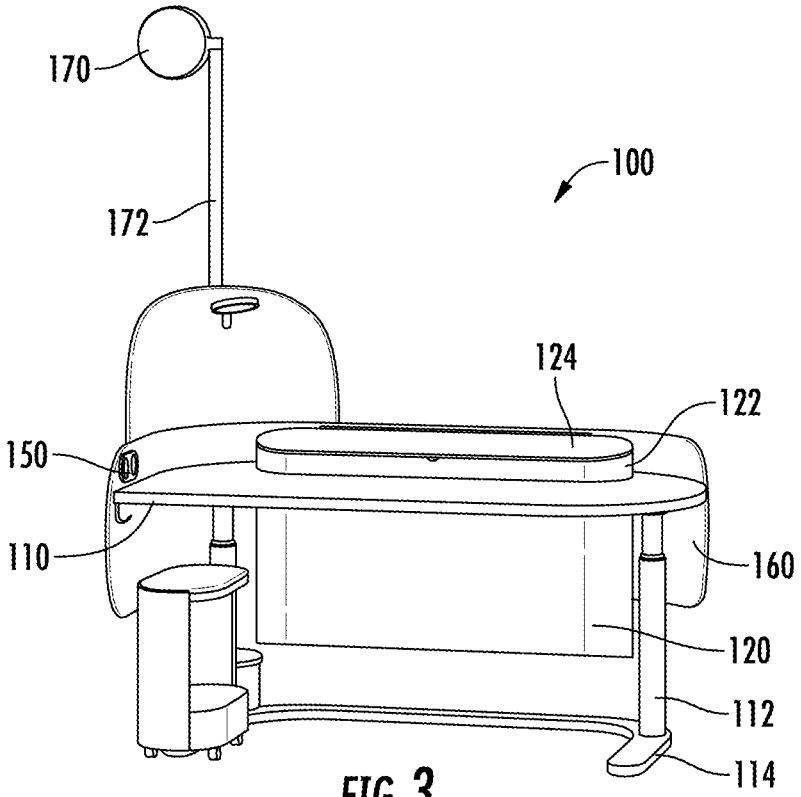
FIG. 3 is a front, perspective view of the example desk of FIG. 1 with a wayfinder according to an example embodiment.

As shown in FIGS. 3 and 4, desk 100 may include an indicator or wayfinder 170 in certain example embodiments. Wayfinder 170 may be configured to assist a user with finding desk 100. For example, controller 200 may be in operative communication with wayfinder 170, and controller 200 may be configured for activating wayfinder 170 to assist the user with finding desk 100. Moreover, controller 200 may be configured for receiving data corresponding to a user desk assignment over network 270, e.g., from external device 280 or server 290, and controller 200 may be configured to activate wayfinder 170 in response to the user desk assignment. As a particular example, desk 100 may be located within a hot desk area with numerous desks that appear similar to desk 100, e.g., as shown in FIG. 6. A user may reserve desk 100 with external device 280, and controller 200 may activate wayfinder 170 to guide the user to desk 100. Wayfinder 170 may be, e.g., an illuminable sign with a distinct pattern, picture, logo, image, color, etc. that is (at least temporarily) unique to desk 100. The user may see the distinct pattern, picture, logo, image, color, etc. on a display of external device 280, and the user may then search for wayfinder 170 in order to find the reserved desk 100. Wayfinder 170 may be mounted on a post 172 above work surface 110 to assist the user with finding desk 100. In certain example embodiments, wayfinder 170 may be mounted on post 172 no less than seven-tenths of a meter (0.7 m) above work surface 110 along the vertical direction V, e.g., when the vertical position of work surface 110 is adjusted such that the user can sit at work surface 110, to assist the user with finding desk 100 when wayfinder 170 is activated.

As shown in FIGS. 1 and 2, desk 100 may include a privacy screen 160. Privacy screen 160 may be mounted to work surface 110, e.g., at rear portion 116 of work surface 110. Privacy screen 160 may extend, e.g., along the lateral direction L and/or transverse direction T, along at least one peripheral edge of work surface 110. For instance, in the example embodiment shown in FIGS. 1 and 2, privacy screen 160 is shaped complementary to a rear and side edge of work surface 110. Privacy screen 160 also extends upwardly, e.g., along the vertical direction V, from work surface 110. Thus, e.g., a top edge 162 of privacy screen 160 may be positioned above work surface 110, e.g., along the vertical direction V. Privacy screen 160 may advantageously provide a user of desk 100 with a visual delimitation of a workspace. Privacy screen 160 may also be slidably coupled to work surface 110, e.g., such that a vertical position of privacy screen 160 relative to work surface 110 is adjustable. Moreover, a user of desk 100 may adjust the privacy screen 160 upwardly along the vertical direction V such that top edge 162 of privacy screen 160 is positioned further above work surface 110, e.g., in order to advantageously provide an increased sense of privacy to the user of desk 100. Conversely, the user of desk 100 may adjust the privacy screen 160 downwardly along the vertical direction V such that top edge 162 of privacy screen 160 is positioned closer to work surface 110, e.g., in order to advantageously provide an increased sense of community with nearby colleagues and/or improve light transmission to the user at desk 100. In certain example embodiments, privacy screen 160 may be movable by no less than one-tenth of a meter (0.1 m) and no greater than a half meter (0.5 m) along the vertical direction V.

As shown in FIGS. 9 and 10, desk 100 may also include a charger 240. Charger 240 may be mounted below work surface 110. Moreover, charger 240 may be configured for wirelessly, e.g., conductively, charging external device 280, such as a smartphone, tablet computer, etc., positioned on work surface 110 above charger 240. Thus, a user of desk 100 may conveniently charge battery operated devices while working at desk 100.

Figure 11:
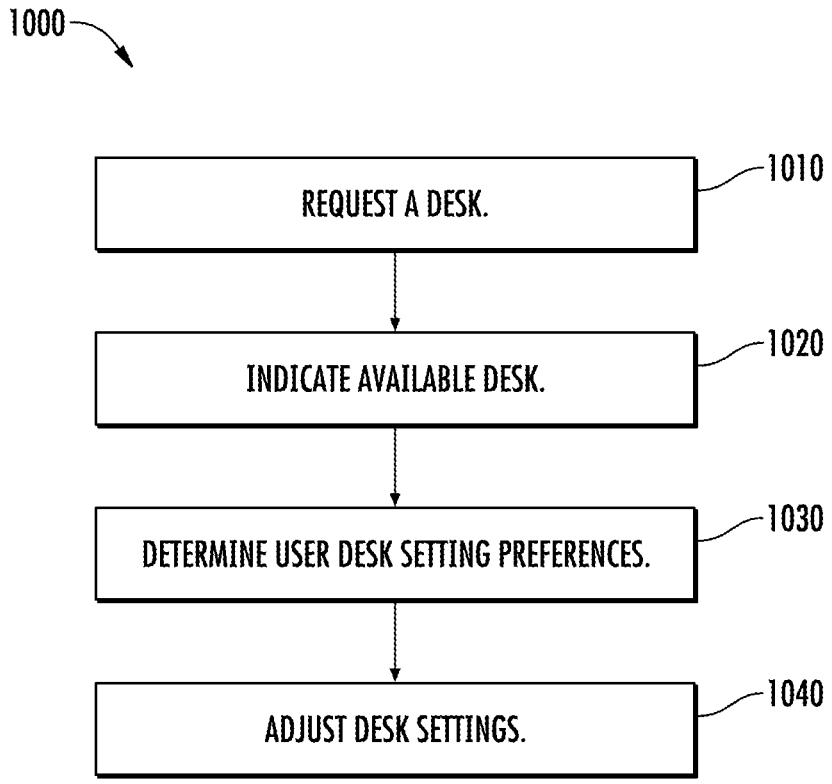
FIG. 11 illustrates a method for operating a desk according to an example embodiment of the present subject matter.

FIG. 11 illustrates a method 1000 of adjusting a desk, such as desk 100. Method 1000 is described in greater detail below in the context of desk 100. However, it will be understood that method 1000 may be used with other suitable agile desks in alternative example embodiments. As discussed in greater detail below, method 1000 may assist with adjusting desk 100 to meet ergonomic requirements of a user.

At 1010, a user may request a desk. For example, the user may input a desk reservation request at external device 280, such as a smartphone or tablet. At 1020, an available desk may be indicated in response to the desk request at 1010. For example, wayfinder 170 may be activated on desk 100, and the user may be presented with an image of wayfinder 170 on external device 280. The user search for desk 100 and see wayfinder 170, which guide the user to desk 100.

At 1030, user desk setting preferences are determined. For example, controller 200 may receive the user desk setting preferences via network 270 from external device 280 and/or server 290. The user desk setting preferences may include one or more of a predetermined vertical position for work surface 110, a predetermined position for stand 130, a predetermined lateral position for carriage 140, and a predetermined tilt of display 50 on swing arm 144. The user desk setting preferences may be saved from a previous session by the user of desk 100. The user desk setting preferences may also be selected by the user on external device 280.

At 1040, the current desk setting of desk 100 may be adjusted to correspond to the user desk setting preferences from 1030. As an example, one or more of actuators 210, 220, 230, 240 may be actuated to correspond to the user desk setting preferences. Moreover, controller 200 may operate one or more of actuators 210, 220, 230, 240 to match desk 100 to one or more of the predetermined vertical position for work surface 110, the predetermined position for stand 130, the predetermined lateral position for carriage 140, and the predetermined tilt of display 50 on swing arm 144.

FIG. 11 depicts steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of method 1000 are explained using desk 100 as an example, it should be appreciated that these methods may be applied to the operation of any suitable desk.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A desk, comprising:

a work surface;

a first actuator coupled to the work surface, the first actuator operable to selectively adjust a vertical position of the work surface;

a casing mounted to the work surface, the casing defining an interior volume sized for receipt of a display, the casing comprising a barrel and a lid, the barrel mounted to the work surface at a rear portion of the work surface, the lid pivotally coupled to the barrel at an opening of the barrel in order to selectively cover the interior volume of the casing, the opening of the barrel positioned above the work surface;

a stand;

a second actuator coupled to the stand, the second actuator operable to selectively adjust the stand between at least a stored position and a deployed position, the stand positioned within the interior volume of the casing in the stored position of the stand, the stand at least partially positioned outside of the interior volume of the casing in the deployed position of the stand;

a carriage mounted to the stand, the carriage configured for supporting the display;

a third actuator coupled to the carriage, the third actuator operable to selectively adjust a lateral position of the carriage; and a controller in operative communication with the first, second, and third actuators, the controller configured for:

receiving data corresponding to a desk configuration over a wireless network, the desk configuration comprising a predetermined vertical position for the work surface, a predetermined position for the stand, and a predetermined lateral position for the carriage; and activating one or more of the first, second, and third actuators to correspond to the desk configuration.

2. The desk of claim 1, wherein a lateral width of the casing is no greater than one and a half meters.

3. The desk of claim 1, wherein the casing comprises a tray mounted within the interior volume of the casing and configured for supporting one or more of a mouse, a keyboard, and a desktop computer, and the lid is pivotally adjustable to selectively cover the tray.

4. The desk of claim 1, further comprising a privacy screen mounted to the work surface at the rear portion of the work surface, a top edge of the privacy screen positioned above the work surface.

5. The desk of claim 4, wherein the privacy screen is slidably coupled to the work surface such that the vertical position of the privacy screen relative to the work surface is adjustable.

6. The desk of claim 1, further comprising a wayfinder, the controller in operative communication with the wayfinder, the controller configured for:

receiving data corresponding to a user desk assignment over the wireless network; and activating the wayfinder in response to the user desk assignment.

7. The desk of claim 6, wherein the wayfinder comprises an illuminable sign mounted on a post above the work surface.

8. The desk of claim 1, further comprising:

a swing arm mounted to the carriage, the swing arm configured for supporting the display; and a fourth actuator coupled to the swing arm, the fourth actuator operable to selectively adjust a tilt of the display.

9. The desk of claim 1, wherein the controller is configured for receiving the data corresponding to the desk configuration from one of a remote user device or a server, the data corresponding to the desk configuration stored within a memory of the one of the remote user device or the server, the desk configuration comprising a previously selected configuration of a user on a different desk.

10. The desk of claim 9, wherein the remote user device comprises a cellphone or a tablet.

11. The desk of claim 1, wherein the controller is configured for receiving the data corresponding to the desk configuration from a remote server, the data corresponding to the desk configuration stored within a memory of the remote server.

12. The desk of claim 11, wherein the controller is further configured for transmitting data corresponding to a request for the desk configuration to the remote server in response to a user input.

13. The desk of claim 12, wherein the user input comprises one or both of a keypad input and a badge scan.

14. A method for adjusting a desk, the desk including a work surface, a first actuator, a second actuator, and a third actuator, the first actuator being coupled to the work surface, the first actuator being operable to selectively adjust a vertical position of the work surface, the second actuator being coupled to a casing of the desk mounted to the work surface, the casing defining an interior volume sized for receipt of a display, the casing comprising a barrel and a lid, the barrel mounted to the work surface at a rear portion of the work surface, the lid pivotally coupled to the barrel at an opening of the barrel in order to selectively cover the interior volume of the casing, the opening of the barrel positioned above the work surface, the second actuator being coupled to a stand of the desk, the second actuator being operable to selectively adjust the stand between at least a stored position and a deployed position, the stand being positioned within the interior volume of the casing in the stored position of the stand, the stand at least partially positioned outside of the interior volume of the casing in the deployed position of the stand, the display being supported by a carriage of the desk mounted to the stand, the third actuator coupled to the carriage, the third actuator operable to selectively adjust a lateral position of the carriage, the method comprising:

receiving, at a controller of the desk and in operative communication with the first, second, and third actuators, data corresponding to a desk configuration over a wireless network, the desk configuration comprising a predetermined vertical position for the work surface, a predetermined position for the stand, and a predetermined lateral position for the carriage; and activating, by the controller, one or more of the first, second, and third actuators to correspond to the desk configuration.

15. The method of claim 14, wherein receiving the data corresponding to the desk configuration comprises receiving the data corresponding to the desk configuration from a remote user device, the data corresponding to the desk configuration stored within a memory of the remote user device, the remote user device comprising a cellphone or a tablet.

16. The method of claim 14, wherein receiving the data corresponding to the desk configuration comprises receiving the data corresponding to the desk configuration from a remote server, the data corresponding to the desk configuration stored within a memory of the remote server.

17. The method of claim 16, further comprising transmitting, from the controller, data corresponding to a request for the desk configuration to the remote server in response to a user input.

18. The method of claim 17, wherein the user input comprises one or both of a keypad input and a badge scan.

19. The method of claim 14, further comprising receiving, by the controller, data corresponding to a user desk assignment over the wireless network; and activating, by the controller and in response to the user desk assignment, a wayfinder in operative communication with the controller.

20. The method of claim 14, further comprising activating a fourth actuator of the desk to selectively adjust a tilt of the display, the fourth actuator being coupled to a swing arm mounted to the carriage, the swing arm configured for supporting the display.

* * * * *